US011346347B2

(12) United States Patent
Smith

(10) Patent No.: US 11,346,347 B2
(45) Date of Patent: May 31, 2022

(54) HIGH VOLUME PORTABLE HAND DRILL PUMP

(71) Applicant: Jason Smith, West Bountiful, UT (US)

(72) Inventor: Jason Smith, West Bountiful, UT (US)

( * ) Notice: Subject to any disclaimer, the term of this patent is extended or adjusted under 35 U.S.C. 154(b) by 0 days.

(21) Appl. No.: 16/813,520

(22) Filed: Mar. 9, 2020

(65) Prior Publication Data

US 2020/0386233 A1 Dec. 10, 2020

Related U.S. Application Data

(60) Provisional application No. 62/815,178, filed on Mar. 7, 2019.

(51) Int. Cl.

| | |
|---|---|
| ***F04D 29/044*** | (2006.01) |
| ***F04D 13/06*** | (2006.01) |
| ***F04D 1/00*** | (2006.01) |
| ***F04D 29/60*** | (2006.01) |
| ***F04D 29/22*** | (2006.01) |

(52) U.S. Cl.

CPC ..... *F04D 13/068* (2013.01); *F04D 1/00* (2013.01); *F04D 29/044* (2013.01); *F04D 29/22* (2013.01); *F04D 29/60* (2013.01); *F04D 13/06* (2013.01); *F04D 13/0646* (2013.01)

(58) Field of Classification Search

CPC ..... F04D 13/068; F04D 29/60; F04D 29/22; F04D 29/044; F04D 13/06; F04D 13/0646

See application file for complete search history.

(56) References Cited

U.S. PATENT DOCUMENTS

| | | | | |
|---|---|---|---|---|
| 2,651,545 | A * | 9/1953 | Shotton | B05B 9/0866 239/333 |
| 3,785,752 | A * | 1/1974 | Crespo | F04D 29/049 417/319 |
| 6,471,495 | B1 * | 10/2002 | Allen | F04D 13/08 417/423.6 |
| 6,817,544 | B2 * | 11/2004 | Hanson | B05B 9/0866 239/329 |
| 2009/0016919 | A1 * | 1/2009 | Mitchell | F04C 23/02 418/161 |
| 2013/0129485 | A1 * | 5/2013 | Kucuk | F04D 13/08 415/124.2 |
| 2017/0107985 | A1 * | 4/2017 | Fess, II | F04D 29/528 |

* cited by examiner

*Primary Examiner* — Courtney D Heinle
*Assistant Examiner* — Andrew J Marien
(74) *Attorney, Agent, or Firm* — Morriss O'Bryant Compagni Cannon, PLLC

(57) ABSTRACT

The present invention is a system and method for pumping a fluid using a high-speed, fluid evacuating pump in which the pump is operated by a battery powered hand drill, wherein a first embodiment of a pump design includes a rigid cylindrical draw tube with the intake placed at the bottom and an outlet disposed near the top, a gear assembly attached to the top of the pump to achieve proper impeller speeds required to reach the targeted fluid pumping volume, and a rigid and segmented driveshaft connected to the gear assembly to drive the impeller placed near the intake of the pump, wherein the driveshaft includes a plurality of solid segments and hollow segments threaded together to thereby decrease vibration of the driveshaft at high RPMs.

12 Claims, 16 Drawing Sheets

HIGH VOLUME PORTABLE HAND DRILL PUMP

BACKGROUND

Field of the Invention

This invention relates generally to pumps for fluids, and more specifically to pumps that may be operated using a hand drill.

Description of Related Art

Fluids have been moved by various pump styles and configurations for centuries. Some of these include centrifugal pumps which are radial, axial, and mixed flow units. A radial flow pump is commonly referred to as a straight centrifugal pump. The most common type is the prior art volute pump 10 as shown in FIG. 1.

Many fluids that need to be moved or transferred are from containers such as barrels or other containers or structures that may have an appreciable depth. This necessitates a variation of a centrifugal pump 12 with a stem 14 that inserts into a barrel 16 as shown in FIG. 2.

This style of pump is one of many variations of a centrifugal pump typically used for pumping oil and gas, caustics, acids, water, etc. The pumps may be operated with a motor or even a hand crank, and they are typically low volume and thus require a great deal of time to move fluids from a container to another location. In order to achieve more productivity and convenience, pumps that are driven by hand drills are often being used.

Another prior art pump 18 shown in FIG. 3 may be operated by a hand drill is a low volume and low speed (approximately 2 gpm) and has a very small inlet 20 and outlet 22. Even though the volume the hand drill operated pump 18 transfers is low, because of its convenience, it is becoming more popular and greater numbers are being manufactured. This style of pump is typically used for transferring oil and anti-freeze.

Even though hand drill pumps may be gaining in popularity because of their ease of setting up and that they may be driven by any battery hand drill, they are severely limited in their applications.

For example, these pumps may bind or freeze if particulate matter runs through the pump. (ADDED the filter screen for this) Furthermore, because of the low volume they move, they may not be economical because of the relatively long time that is required to move a small amount of fluid. Unfortunately, their design inherently prevents higher pump speeds to move larger volumes of fluid in a shorter amount of time. Some of these limitations may include bearing style/configuration, the type of seals that are used, and excess vibration at higher RPM that causes premature failure.

In addition, one of the most severe limitations is that the ability to apply torque to the impeller is limited because of the limited torque provided by the hand drill. This pump is further limited by the depth of fluid that can be pumped and head pressure. The small inlet and outlet size of this style of pump combined with a hose on each side contribute to pump inefficiencies. These inefficiencies manifest as slower volume flow and heat build-up in the pump which drastically lowers pump life and increases the chances of pump failure.

Accordingly, it would be an advantage over the prior art to provide a portable pump that could move a greater volume while still utilizing a hand drill, could be used in an environment that contains particulate matter, could manage a higher torque without damage or failure, and could reach greater depths without losing pump efficiency.

BRIEF SUMMARY

The present invention is a system and method for pumping a fluid using a high-speed, fluid evacuating pump in which the pump is operated by a battery powered hand drill, wherein a first embodiment of a pump design includes a cylindrical draw tube with the intake placed at the bottom and an outlet disposed near the top, a gear assembly attached to the top of the pump to achieve proper impeller speeds required to reach the targeted fluid pumping volume, a driveshaft connected to the gear assembly to drive the impeller placed near the intake of the pump, seals and other components placed inside the pump to support the driveshaft, to direct flow, and to increase outlet pressure, and to keep fluid and particulate matter out of the driveshaft support bearings and a filtering mesh having a large amount of screen area attached to the inlet portion of the pump, thereby blocking larger debris from entering the pump and causing damage to the internal components.

In a first aspect of the invention, the invention uses a high efficiency gear box that eliminates corrosion.

In a second aspect of the invention, the invention uses an impeller at the bottom of a draw tube.

In a third aspect of the invention, the invention uses a screen on the outside portion of the draw tube to eliminate particulate matter from entering the system.

In a fourth aspect of the invention, the invention uses components throughout the pump that have clearance that allows any particulate matter that is smaller than the screen size to pass through the pump without causing damage to pump components.

In a fifth aspect of the invention, the invention uses a multi-section driveshaft design that enables the impellers to rotate at a very high RPM without vibration.

In a sixth aspect of the invention, the invention uses a device to dampen drill torque, prevent drill body rotation, and achieve one handed operation.

These and other embodiments of the present invention will become apparent to those skilled in the art from a consideration of the following detailed description taken in combination with the accompanying drawings.

DETAILED DESCRIPTION

Reference will now be made to the drawings in which the various embodiments of the present invention will be discussed so as to enable one skilled in the art to make and use the invention. It is to be understood that the following description illustrates embodiments of the present invention and should not be viewed as narrowing the claims which follow.

Figure 1:
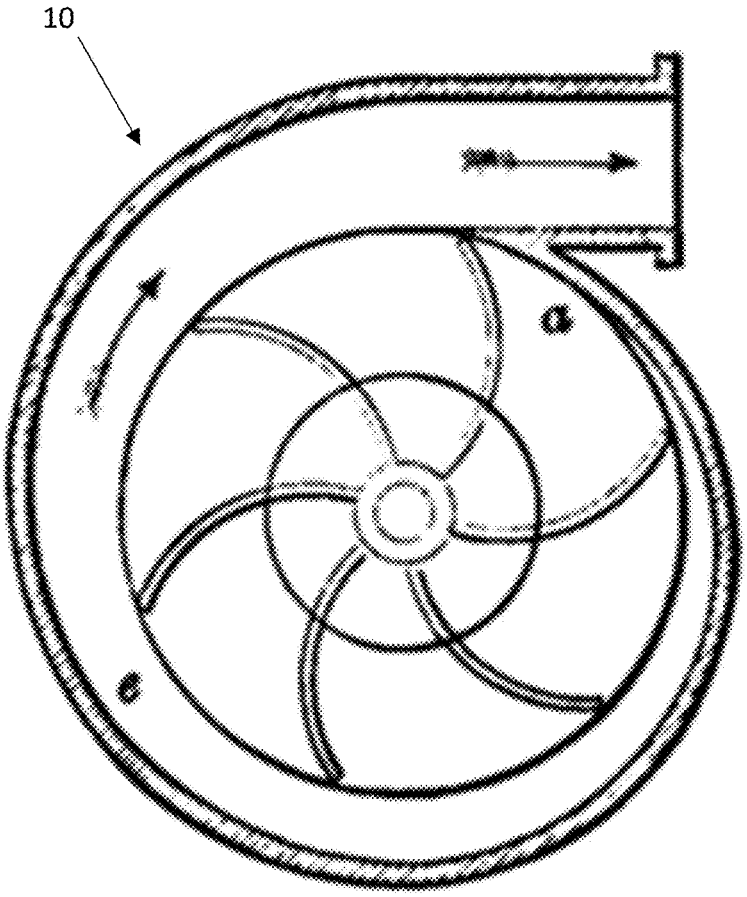
FIGURE 1 PRIOR ART
FIG. 1 is a cross sectional view of a prior art centrifugal pump of the prior art.
Figure 2:
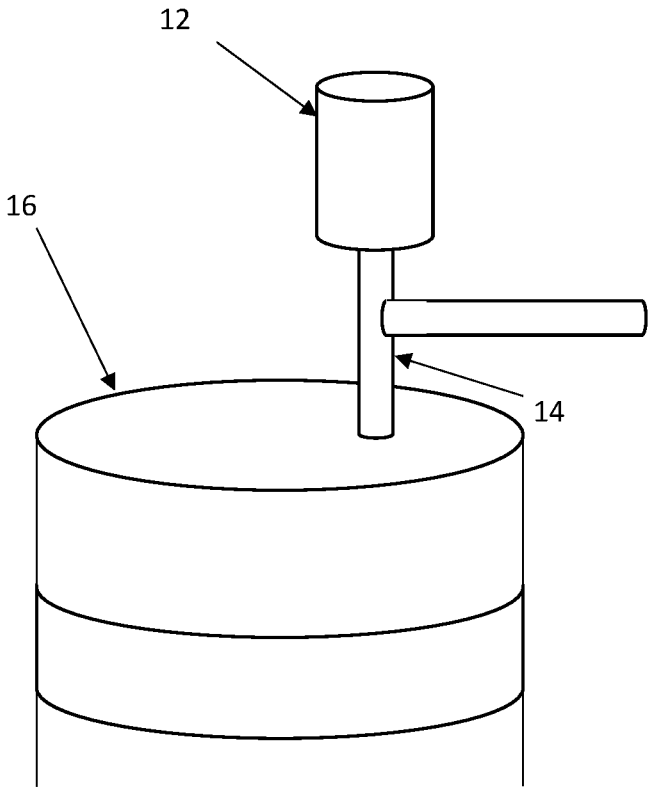
FIGURE 2 PRIOR ART
FIG. 2 is a perspective view of a prior art centrifugal pump with a stem that inserts into a container.
Figure 3:
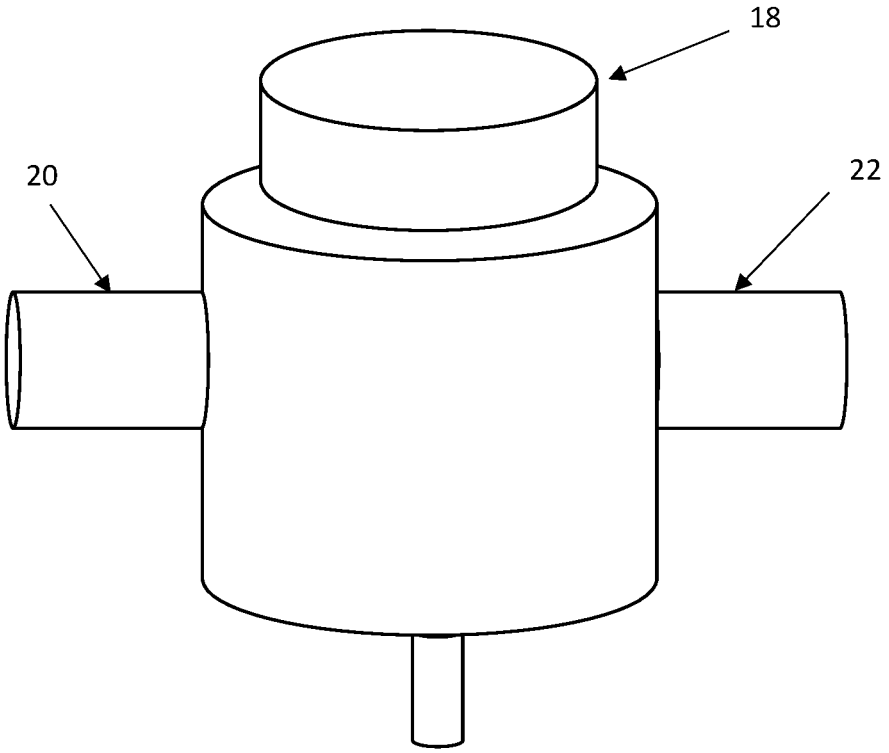
FIGURE 3 PRIOR ART
FIG. 3 is a perspective view of a prior art centrifugal pump that can be operated with a motor or even a hand crank.
Figure 4:
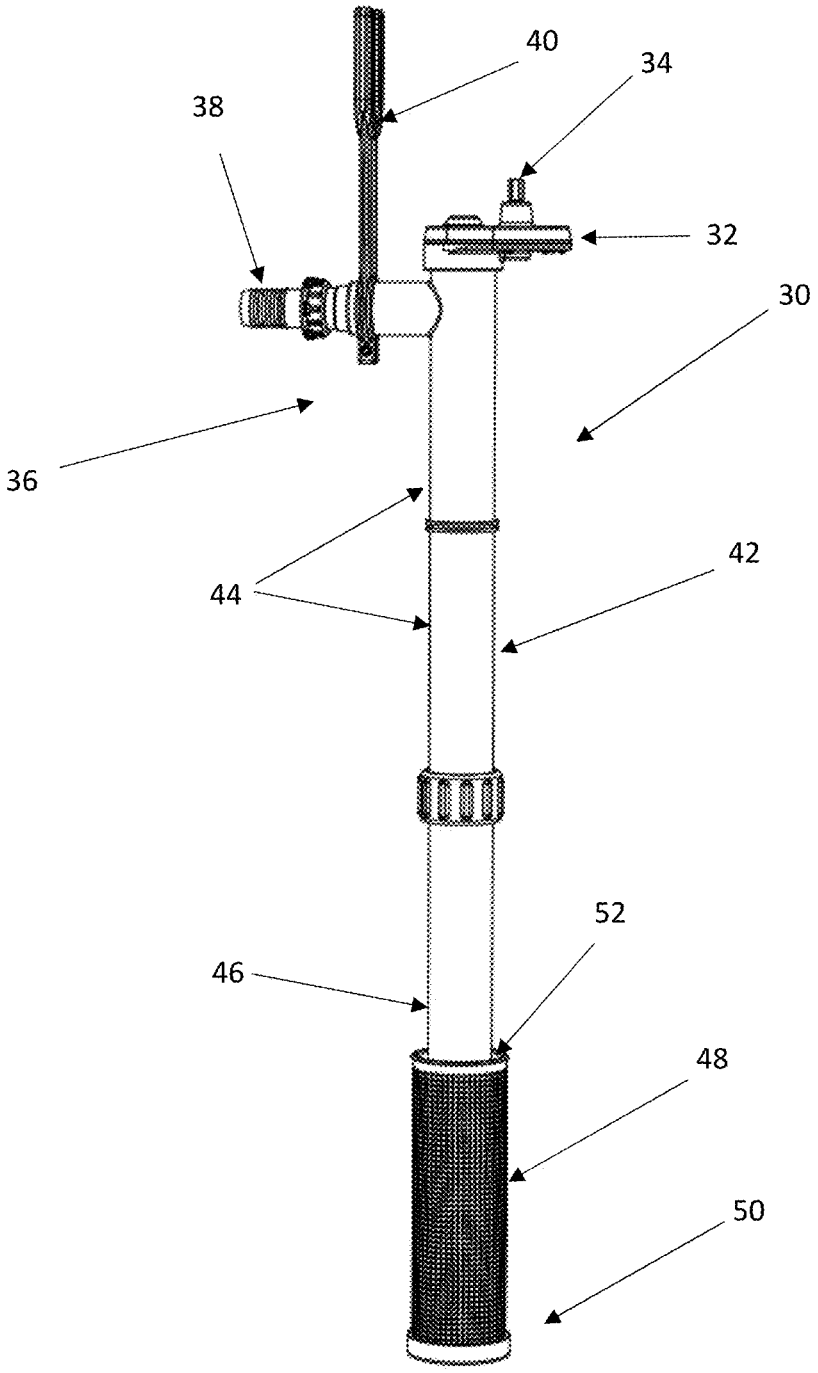
FIG. 4 is a perspective view of the overall design and layout of the high-volume portable hand drill pump of the first embodiment.

A first embodiment of the present invention is a hand drill powered pump 30 as shown as a completely assembled unit in FIG. 4. This first embodiment incorporates features intended for pumping a larger volume of fluid than comparable pumps all while using a portable source of power. As will be shown, an off-the-shelf, battery-powered hand drill may be the only source of mechanical energy required to operate the pump 30.

The hand drill powered pump may also be designed for ease of transportation and has the adjustability to adapt to all brands of cordless drills. It should also be understood that even a portable hand drill with an electrical cord as opposed to a battery, may be used to power the pump 30.

Some features of the hand drill powered pump 30 include a gear assembly 32 having an attachment 34 for a hand drill (not shown). The gear assembly 32 is disposed at an outlet end 36 of the hand drill powered pump 30. The gear assembly 32 may also function as a cap to seal the outlet end 36 of the hand drill powered pump 30.

The hand drill powered pump 30 also includes a fluid outlet 38 where the fluid that is sucked into the and drill powered pump 30 is forced out. Attached to the fluid outlet 38 is a hand drill mounting fork 40.

The hand drill powered pump 30 also includes a cylindrical draw tube 42 that extends the length of the hand drill powered pump. It should be noted that the length of the draw tube 42 may be adjustable. For example, the user may be able to use a shorter draw tube 42. The first embodiment of the draw tube 42 shown in FIG. 4 is in two draw tube segments, a top draw tube segment 44 and a bottom draw tube segment 46.

Similarly, the draw tube 42 may also be extended by adding an additional draw tube segment below the bottom draw tube segment 46. Accordingly, it should be understood that the embodiments of the invention include a draw tube 42 whose length is not fixed and may be adjusted as needed by adding or removing draw tube segments.

A final feature of the first embodiment shown in FIG. 4 is a cylindrical filtering screen 48 disposed over a suction end 50 of the draw tube 42. The embodiments of the invention are equipped to manage dirty fluid when particulate matter that could damage the pump mechanism is separated from the fluid by use of the filtering screen 48.

Figure 5:
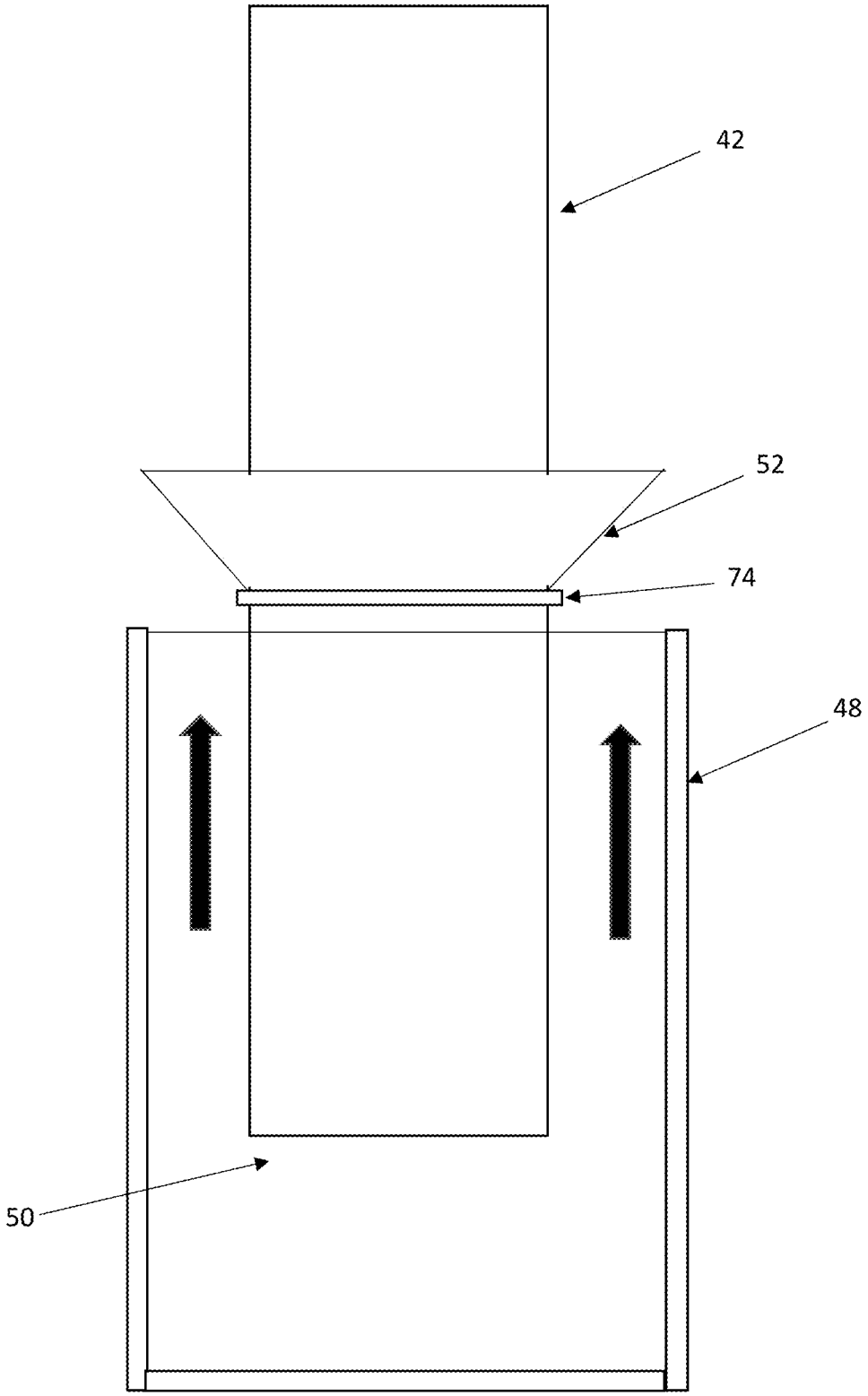
FIG. 5 is a close-up and perspective view of a portion of the draw tube illustrating how the removable filtering screen is mounted and held in place on the end of the pump.

As shown in FIG. 5, the filtering screen 48 may make a sealed fit around the draw tube 42 using a flexible seal 52 that is disposed in a gap between the filtering screen and the draw tube 42 and held in place using the ridges 74. The flexible seal 52 may be disposed around the draw tube 42 between the ridges 74 and extend outwards therefrom and may be at an angle away from the filtering screen 48 as shown in FIG. 5. The arrows show the direction that the filtering screen 52 is moved to insert the filtering screen onto the suction end 50 of the draw tube 42. The filtering screen 48 then makes a relatively tight friction fit over the flexible seal 52. The flexible seal 52 may be made of a relatively rigid rubber or rubber-like material that firmly holds the filtering screen 48 in place. Nevertheless, when the filtering screen 48 needs to be removed for cleaning or transport, it easily slides off the flexible seal 52 and off the draw tube 42.

It is noted that when the filtering screen 48 is disposed on the suction end 50 of the draw tube 42, there is a gap between the bottom of the filtering screen and the suction end of the draw tube. By leaving this gap, fluid may be drawn through the filtering screen 48 along its entire length and not just through the bottom, thus substantially increasing the surface area of the filtering screen through which the fluid may be drawn.

The length and width of the draw tube 42, the filtering screen 48 and the flexible seal 52 are not drawn to scale but are exaggerated to illustrate the features being described in FIG. 5.

Figure 6:
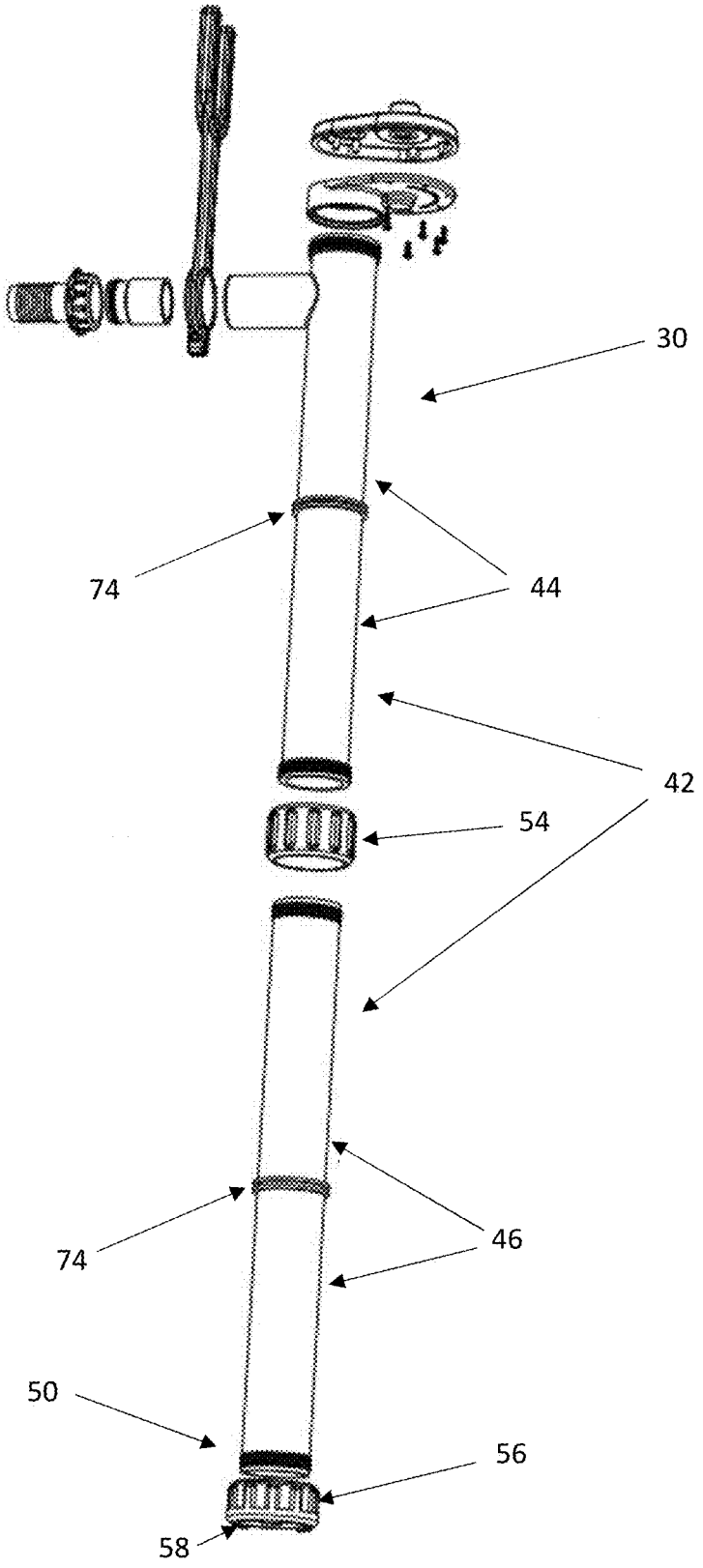
FIG. 6 is an exploded perspective view of the portable hand drill pump.

FIG. 6 is a perspective and exploded view of the outer components of the hand drill powered pump 30. A first important feature shown here is a connecting ring 54 disposed between the top draw tube segment 44 and the bottom draw tube segment 46. The connecting ring 54 enables the total length of the draw tube 42 to be extended as shown. Thus, if the draw tube 42 needed to be extended further, another connecting ring would be disposed at the bottom of the bottom draw tube segment 46.

However, instead of another connecting ring at the bottom of the suction end 50, the first embodiment shows an end ring 56. The end ring 56 may have two purposes. A first purpose may be to provide circumferential spacing for the filtering screen 48 (see FIGS. 4 and 5). The circumferential spacing may only be used to prevent too much movement of the filtering screen 48 when it is disposed on the end of the draw tube 42. However, the filtering screen 48 only makes a tight friction fit with a seal, and not with the end ring 56. In this way, the fluid may easily pass by the end ring 56 and up into the section end 50 of the draw tube 42.

More specifically, when the filtering screen 48 is disposed over the suction end 50 of the draw tube 42, the filtering screen may have a circumferential clearance around the draw tube 42 of up to 0.5 inches. Thus, the filtering screen 48 may be up to an inch larger in diameter than the draw tube 42. To keep the filtering screen 48 from damaging itself by movement or from coming loose from the flexible seal 52

(see FIGS. 4 and 5), the diameter of the end ring 56 should be sufficient to minimize movement of the filtering screen but still allow the filtering screen to slide into it.

It should also be understood that the filtering screen 48 may be more than 1.0 inch larger in diameter or less than 1.0 inch in diameter than the draw tube 42 without departing from the principles of the first embodiment.

A second purpose of the end ring 56 may be to provide lengthwise spacing between the filtering screen 48 and the suction end 50. In other words, it is important to keep the bottom of the filtering screen 48 from being flush with the suction end 50 of the draw tube 42 so that the entire surface of the filtering screen may be used to filter the fluid being drawn into the suction end. Accordingly, the end ring 56 may include protrusions 58 along a bottom edge of the end ring that enable the fluid to pass between the protrusions and the bottom of the filtering screen and into the suction end 50.

Another feature of each draw tube segment 44, 46 is shown as the ridges 74 disposed approximately halfway along the length. In other words, the draw tube segments may be identical to each other and may include the ridges 74. The function of the ridges 74 are to provide a location where the flexible seal 52 may be attached to the bottom draw tube segment and is prevented from sliding up or down the length of the bottom draw tube segment.

Figure 7A:
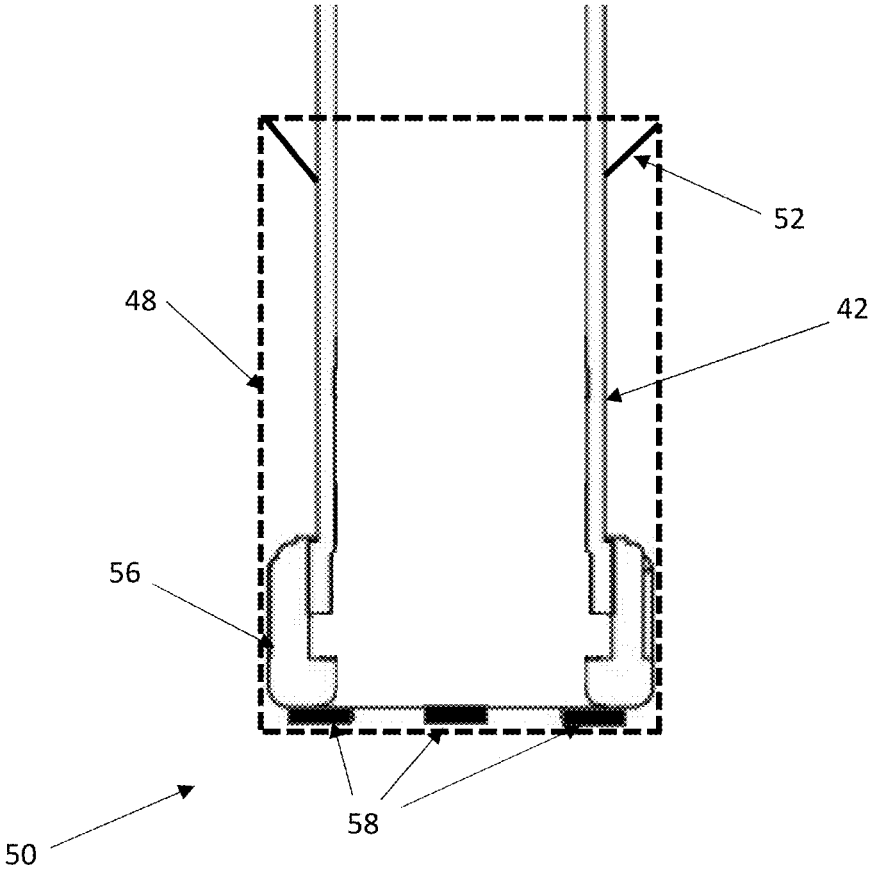
FIG. 7A is a close-up and cut-away profile view illustrating how the filtering screen is held in place on the end of the pump.

FIG. 7A shows a close-up and cross-sectional view of the suction end 50 of the draw tube 42. This figure shows the filtering screen 48 in dashed outline so that it is easier to see the end ring 56 coupled to the end of the draw tube 42. The protrusions 58 may be relatively small and still provide sufficient clearance between the draw tube 42 and the bottom of the filtering screen 48.

Figure 7B:
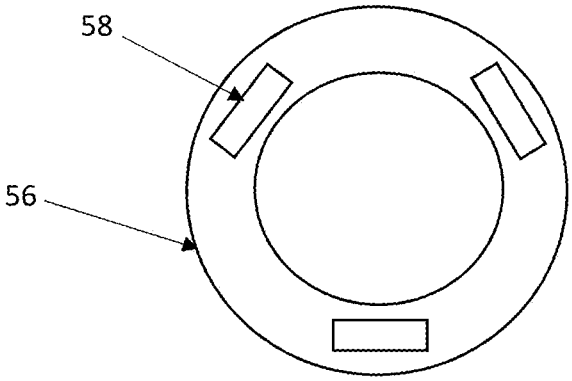
FIG. 7B is a bottom view of the end ring that illustrates placement of protrusions in a first embodiment of the invention.

FIG. 7B is provided to illustrate a bottom view of the end ring 56. This view shows one embodiment of the protrusions 58 which may be any desired shape or number as long as they are short in length so that fluid may pass by them and through to the suction end 50 of the draw tube 42.

Figure 8:
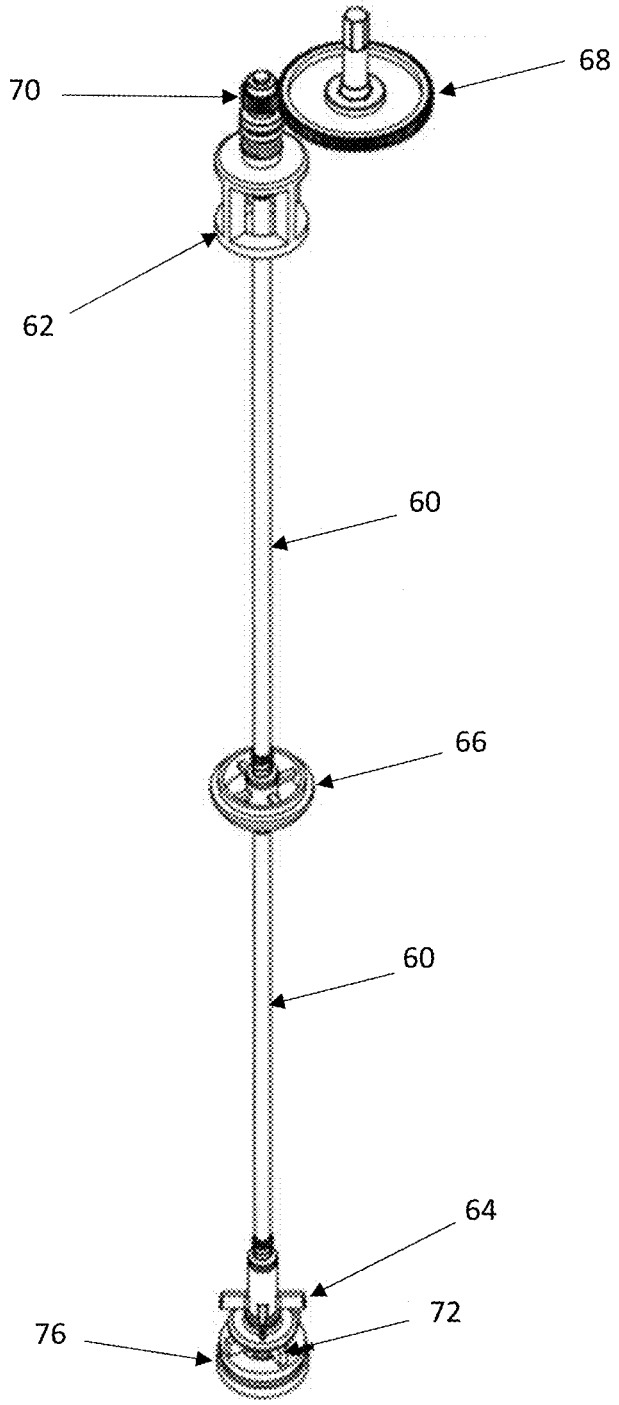
FIG. 8 is a perspective view of the internal parts assembled without the draw tube body shown in FIG. 6.

FIG. 8 is a perspective drawing of the internal components of the hand drill powered pump 30 including a driveshaft 60, an outlet discharge impeller 62, a bottom suction impeller 64, support bearings/bushings, seals, a flow device 66 at the midpoint of the driveshaft 60 used to direct the flow of fluid up the driveshaft and which may also act as a driveline support bearing, a bottom-flow device 72 at the bottom of the driveshaft 60 used to direct the flow of fluid up the driveshaft, a bottom support ring 76, an input gear 68 and a driveshaft gear 70.

The driveshaft 60 spans from the gear assembly 32 containing the input gear 68 and the driveshaft gear 70 at the top of the draw tube 42 to the bottom-flow device 72. The driveshaft 60 is rotated by the input gear 68 and the driveshaft gear 70. The input gear 68 is coupled to the drive shaft gear 70 and may spin the driveshaft at four times the speed of the hand drill operating the hand drill powered pump 30.

It should be understood that the gear ratio between the input gear 68 and the driveshaft gear 70 may be adjusted by changing the diameter of the gears to obtain a desired change in speed and thus volume of the hand drill powered pump. Thus, while the existing gear ratio provides a 4X increase in speed of the driveshaft 60 relative to the hand drill, the specific gear ratio may be changed by altering the input gear 68 and/or the driveshaft gear 70 as known to those skilled in the art.

The specific shape of the outlet discharge impeller 62 and the bottom suction impeller 64 was selected after experimentation with various impeller cross sections. However, the first embodiment has incorporated what was found to be the most efficient design that provided the greater impelling force resulting in the largest volume of fluid flow. The shape is essentially flat and rectangular for each fin. Accordingly, four impeller fins are used in both the outlet discharge impeller 62 and the bottom suction impeller 64. The number of impeller fins should not be considered as limiting and may be adjusted and still be within the scope of the present invention.

It is also noted that the flow device 66 that is disposed at the midpoint of the driveshaft 60 is also disposed where the connecting ring 54 is used to connect the top draw tube segment 44 and the bottom draw tube segment 46 (see FIGS. 4 and 6).

It was determined that without the support of the flow device 66, the driveshaft 60 may begin to wobble in the draw tube 42. Accordingly, if the draw tube 42 were to be extended by adding an additional draw tube segment, it would also be necessary to add another flow device 66 where the new driveshaft segment would be added to the existing driveshaft segments. In this way, the total length of the draw tube 42 and thus of the hand drill powered pump 30 may be extended without limit.

Figure 9:
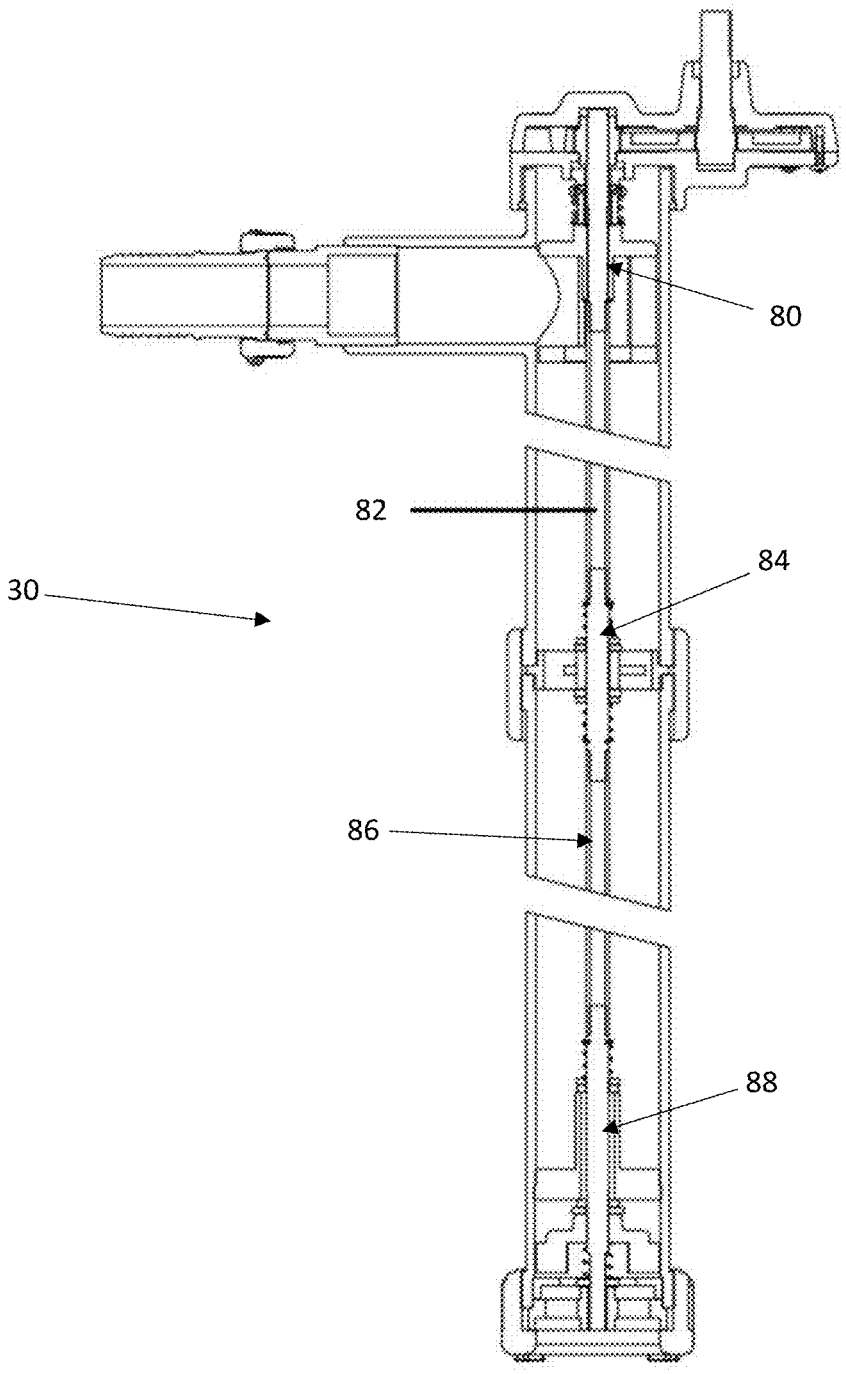
FIG. 9 is a cut-away and profile view of the pump that illustrates the hollow and solid sections of the driveshaft.

FIG. 9 is a cross-sectional view illustrating a partial view of the assembly of the hand drill powered pump 30. Of particular importance to the design is the use of a hollow driveshaft 60 that is separated into various pieces and then threaded together at bearing and bushing locations. Hollow lightweight tubing is used for the driveshaft 60 to help reduce vibration. In addition, any solid piece in the driveshaft 60 is placed in-line with a driveshaft support bearing. Thus, construction of the hand drill powered pump 30 may not be achieved using a single piece driveshaft 60.

The first embodiment of the invention shows a total of five driveshaft segments 80, 82, 84, 86, 88, with driveshaft segments 80, 84 and 88 being short and solid segments, and driveshaft segments 82 and 86 being longer hollow segments.

It is noted that a thread locking device such as an adhesive or thread retaining compound may be used to connect the main driveshaft components together.

Figure 10:
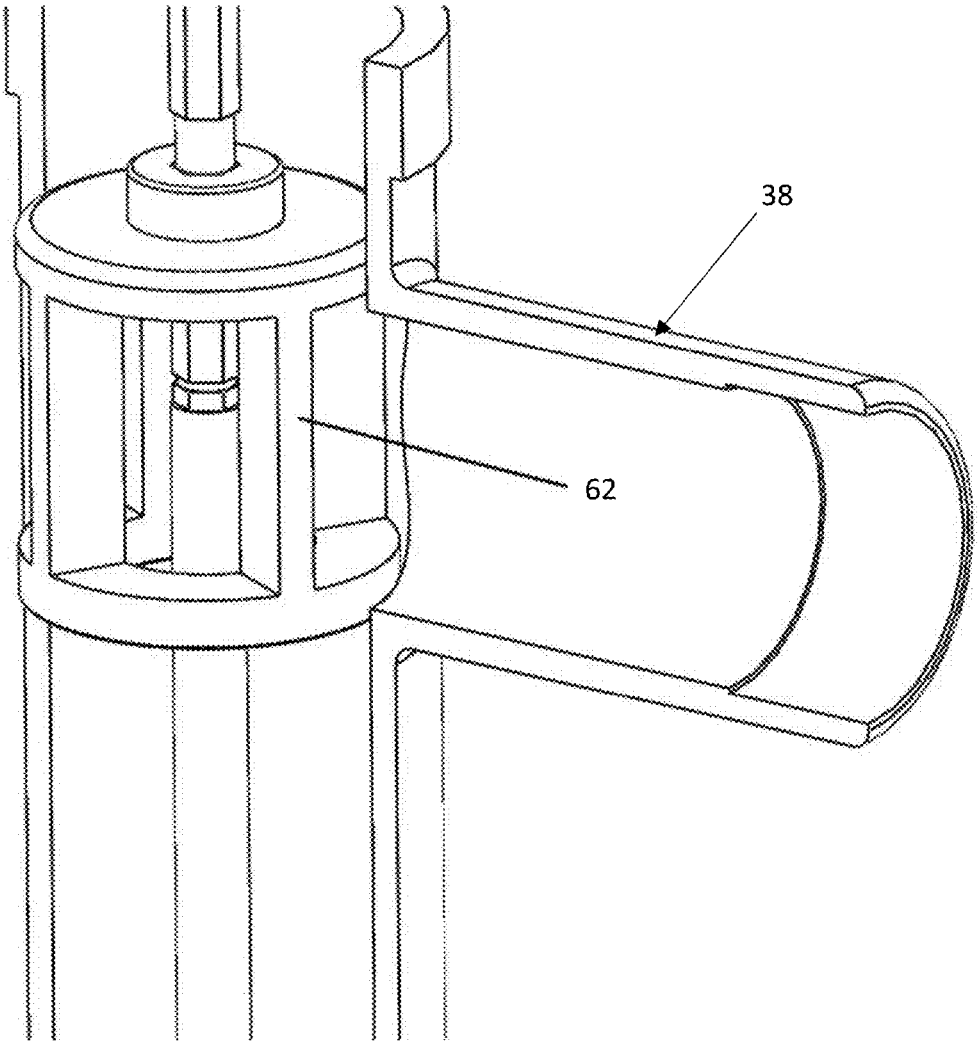
FIG. 10 is a close-up cut-away perspective view of the fluid outlet and the outlet discharge impeller.

FIG. 10 is a close-up and cross-sectional view illustrating the position of the outlet discharge impeller 62. The outlet discharge impeller 62 is disposed directly in-line with the fluid outlet 38 to increase outlet discharge pressure, which is also known in the pump industry as head pressure.

It is noted that no other impeller should be placed within twelve inches above or below the fluid outlet 38.

Figure 11:
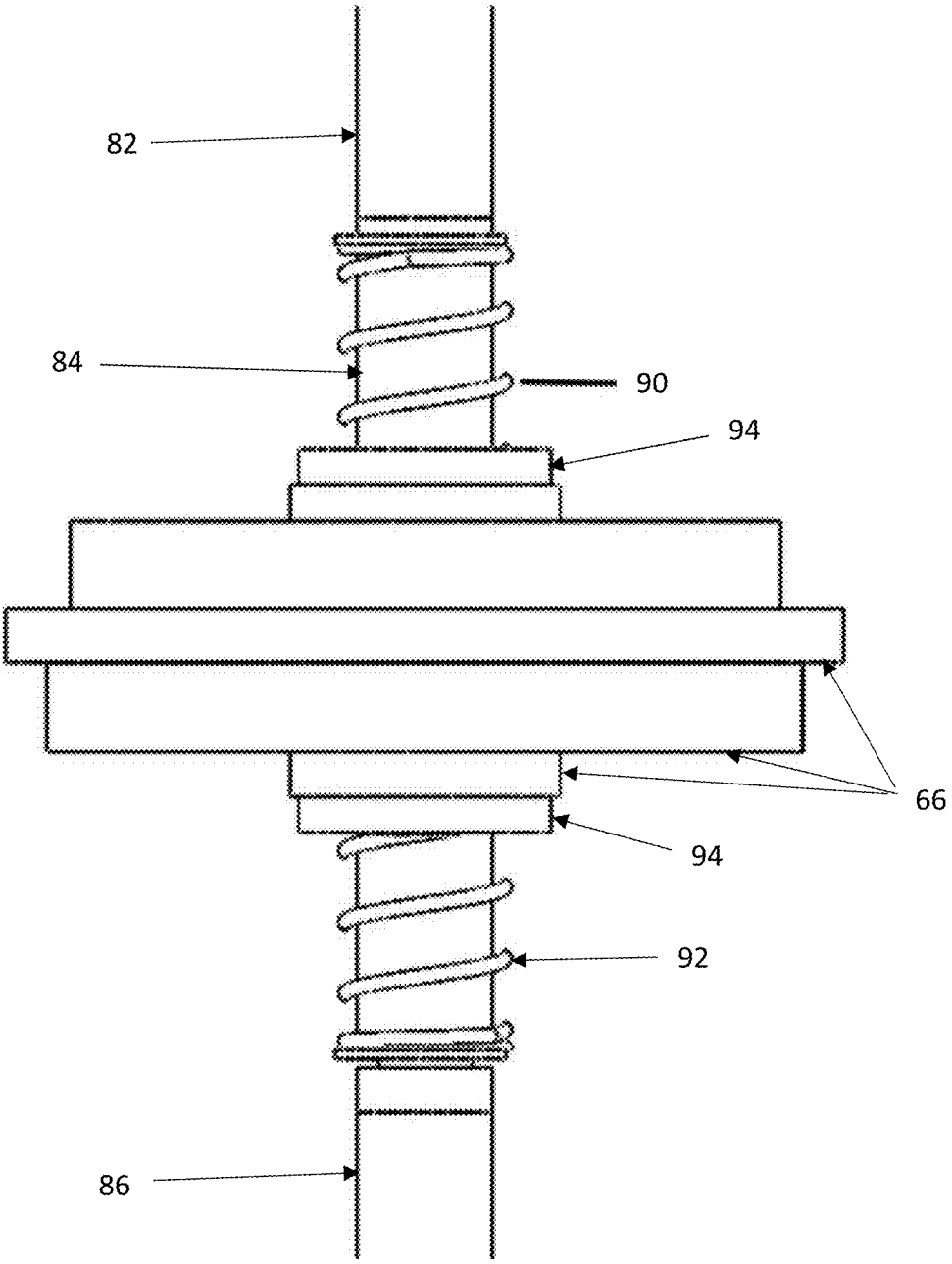
FIG. 11 is a close-up and profile view that illustrates the center support Teflon bearings/bushings and seals to keep particulate matter from entering the driveshaft.

FIG. 11 is an illustration describing a seal design that is used to keep particulate matter out of driveshaft bearings. If particulate matter were to get in-between the driveshaft 60 and a support bearing at a high RPM, damage may be caused to the driveshaft resulting in vibration and premature failure of the hand drill powered pump 30.

The seal is made up of a top spring 90 and bottom spring 92 with a desired spring rate. The spring pressure is directed on top of a Teflon® (PTFE) shim 94 that can manage the high speeds of a hand drill while in operation. The Teflon® may also be used in bushings and\or bearings on the driveshaft, or any other material with a coefficient of 0.2 or less. Also shown are the hollow driveshaft segments 82 and 86 and the solid driveshaft segment 84.

It is noted that the spring may have a load rating of 1.695 Nm (15 lbs./in.) or less pressed against a Teflon® shim to thereby create a proper seal for keeping debris out of the driveshaft and support bushings/bearings.

Figure 12:
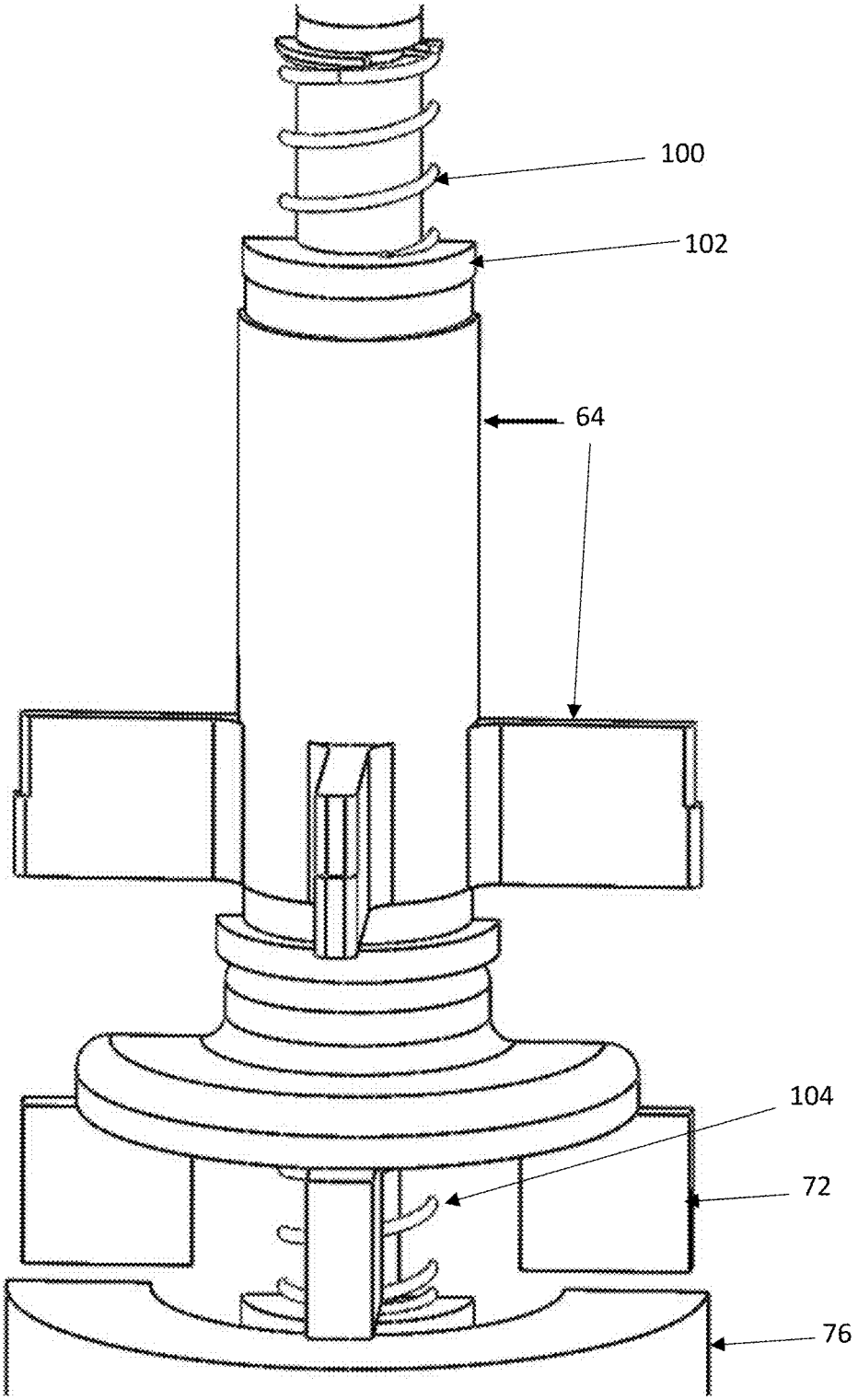
FIG. 12 is a close-up and perspective view illustrating placement of the suction impeller and a device to direct flow while supporting the driveshaft.

FIG. 12 is a close-up and perspective view illustrating the bottom-flow device 72, the bottom support ring 76 and the bottom suction impeller 64. The bottom-flow device 72 (which may be fixed or rotating) and the bottom suction impeller 64 may serve two main functions of the hand drill powered pump 30. The first function of the bottom-flow device 72 is to direct fluid flow up the draw tube 42. Cavitation of fluid may be a common issue with many different styles of pumps. This bottom-flow device 72 directs fluid flow and prevents air pockets from forming inside the draw tube 42.

The bottom-flow device 72 may also be used as a lower driveline support bearing and utilizes the same seals as described in FIG. 11, including a top spring 100, a Teflon® shim 102, a bottom spring 104 and a Teflon® shim (not shown).

Figure 13:
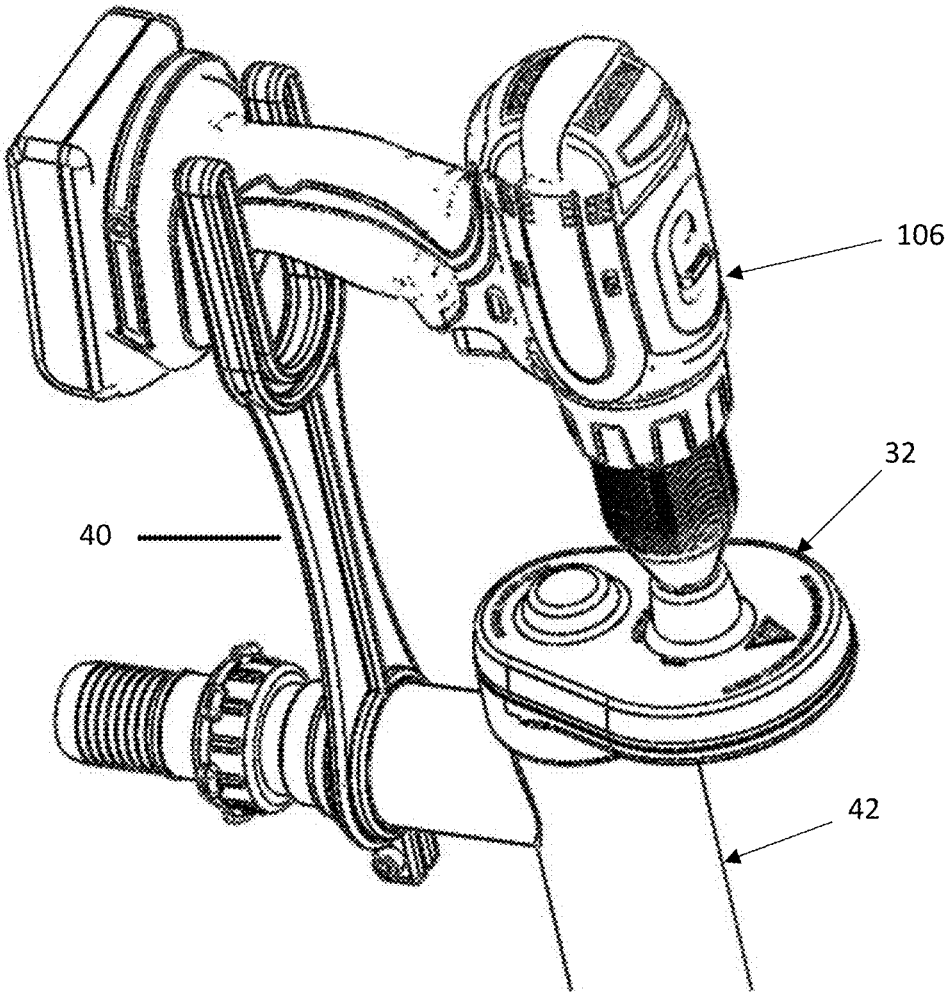
FIG. 13 is a close-up and perspective view illustrating how a cordless hand drill attaches to the gear assembly.

FIG. 13 is a close-up and perspective view that illustrates how a cordless hand drill 106 may be mounted to the input gear 68 (not shown) inside the gear assembly 32. The hand drill mounting fork 40 may be located near a grip of the hand drill 106 which prevents rotation of the body of the hand drill relative to the draw tube 42 during operation. With a certain amount of torque created during operation of the hand drill powered pump 30, the hand drill mounting fork 40 was created to dampen the torque and in return making the hand drill powered pump a one-handed operation.

It should be understood that any mechanism that may keep the hand drill from rotating with respect to the pump may be implemented in place of the hand drill mounting fork 40 without departing from the scope of the invention.

Figure 14:
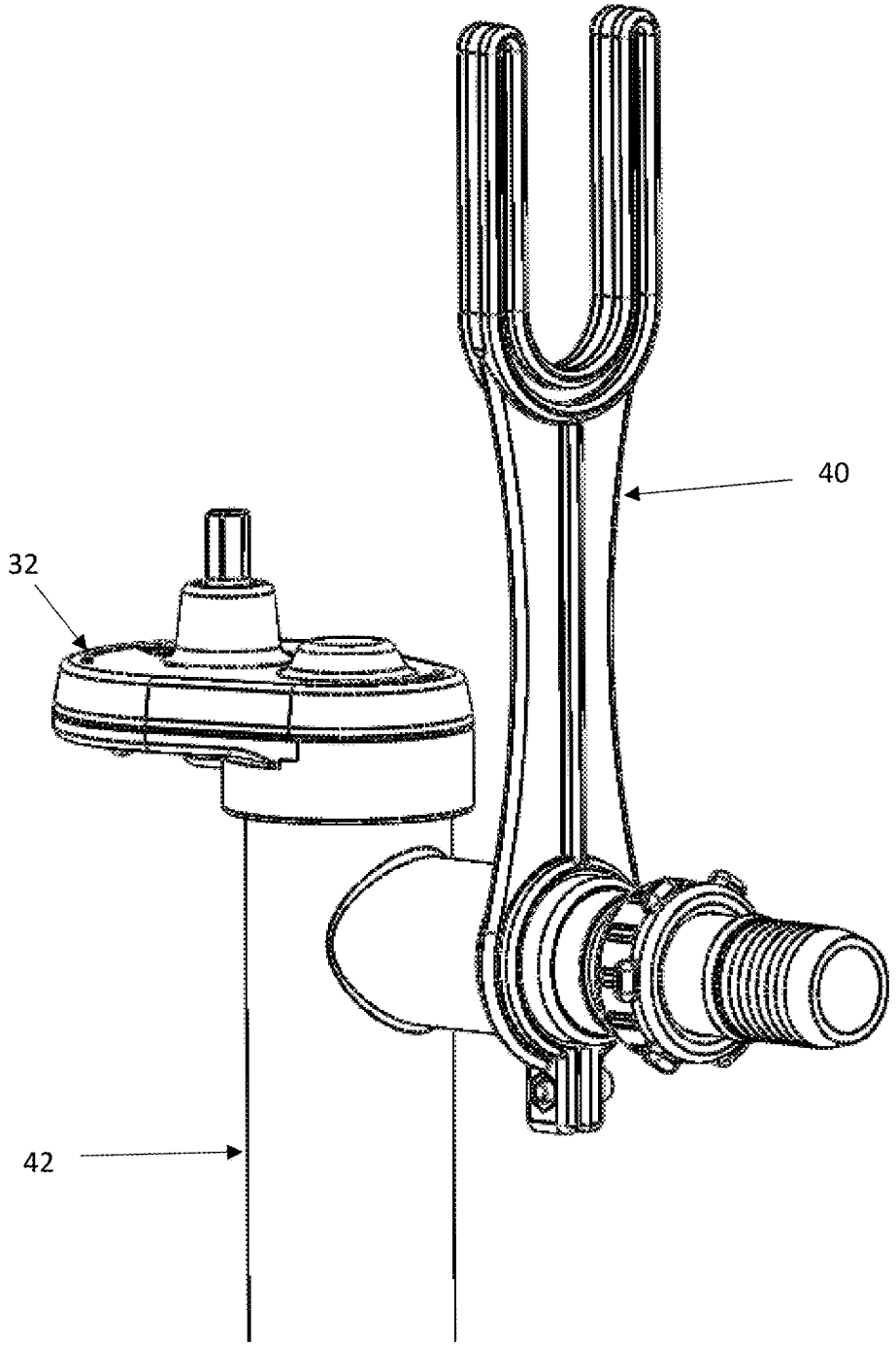
FIG. 14 is a close-up and perspective view of a device to prevent the hand drill from rotating with respect to the pump while in operation.

FIG. 14 is a different view of the hand drill mounting fork 40, the gear assembly 32, and the draw tube 42 shown in FIG. 13.

Figure 15:
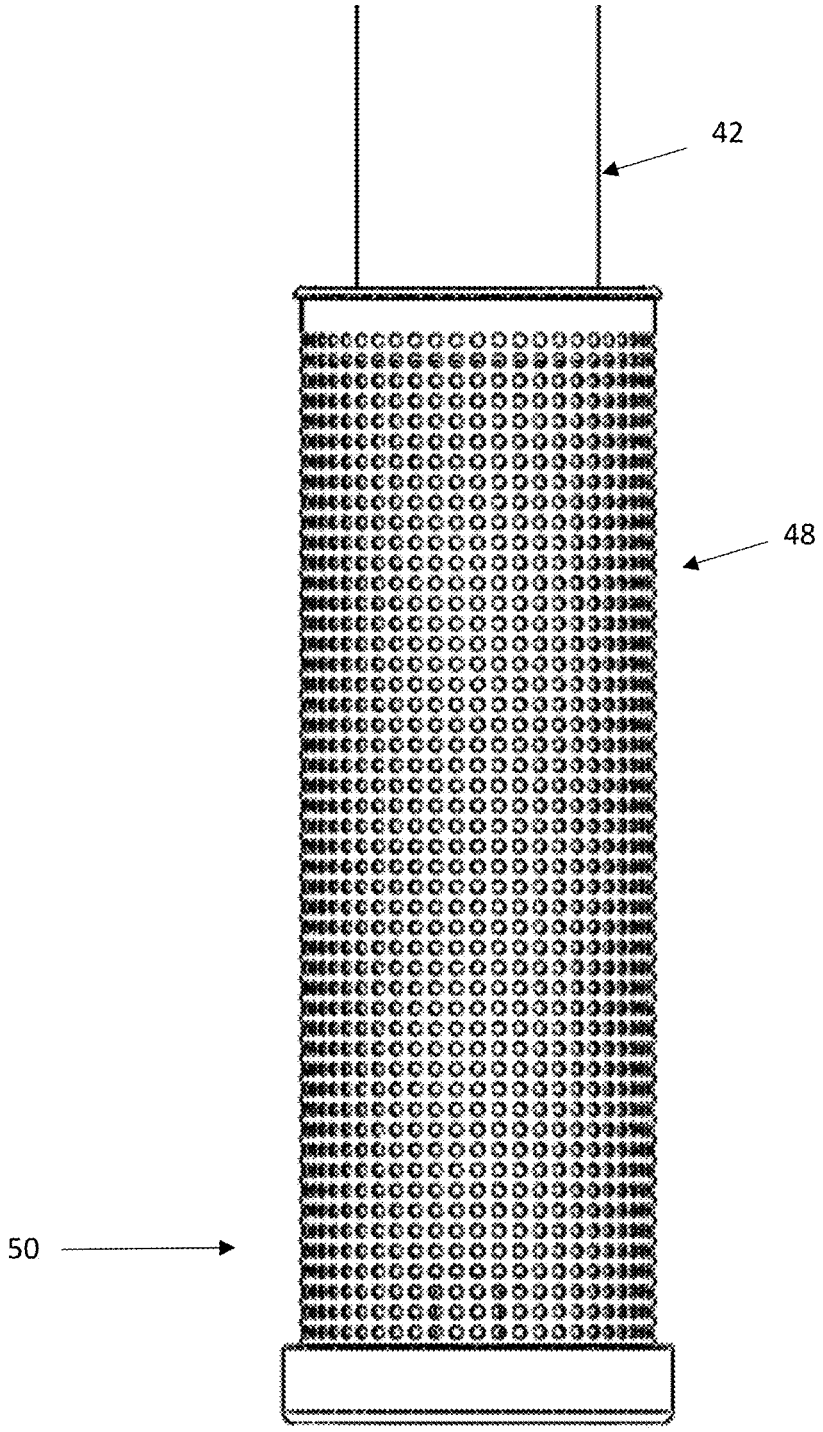
FIG. 15 is a close-up and profile view that illustrates the filtering screen attached to the bottom of the pump.

FIG. 15 is a close-up profile view of the filtering screen 48 disposed on the suction end 50 of the draw tube 42. Without the use of this filtering screen 48, damage may occur to the internal parts of the hand drill powered pump due to the tolerances between the outlet discharge impeller 62, the bottom suction impeller 64 and the draw tube 42 (see FIGS. 6 and 8). Thus, with the use of this filtering screen 48, no particulate matter or debris larger than the screen openings may enter the hand drill powered pump. Any particulate matter that does get through the openings in the filtering screen 48 may travel all the way through the draw tube 42 and be discharged out of the hand drill powered pump 30.

Experimentation has demonstrated that particulate matter is sufficiently filtered from the fluid that passes through the draw tube 42 if the size of the openings in the filtering screen 38 are in the range of 0.07 mm to 5.1 mm and every size in between.

Certain aspects of the first embodiment of the invention may be further explained to offer insight into operation of the hand drill powered pump 30. For example, regarding the hand drill that powers the pump, an impeller disposed at the bottom/inlet of the pump must be rotated at a relatively high RPM. However, because the speed of the hand drill is usually insufficient to reach the necessary speeds to achieve the desired fluid volume of the pump, the cordless drill is disposed on the input shaft of the gear assembly. This design makes the hand drill powered pump a portable device that may be operated by portable power source.

The speed of hand drills used to power the hand drill powered pump may vary. For example, it has been determined that RPM ranges of the hand drill may vary between 1,200 and 20,000 RPM and all RMPs in between.

Another feature of the first embodiment may be the inclusion of a flow metering device disposed anywhere within the flow of fluid within the hand drill powered pump 30, such as at the suction end 50, the fluid outlet 38 or any convenient location in between. The flow metering device may display fluid flow in any convenient measurement units that may include but should not be considered as limited to liters per minute, flow rate, etc.

A final feature of the hand drill powered pump 30 is that a variety of attachments may be coupled to the fluid outlet 38 in order to make the pump attachable to a variety of hoses or pipes.

The flow rate of the hand drill powered pump has been measured as high as 33 GPM. It is believed that the pump may operate at higher flow rate. Accordingly, it should be noted that the pump may operate at flow rates as high as 100 GPM without difficult, as long as the hand drill is operating at sufficiently high speeds.

The draw tube and other housing components of the pump may also be manufactured using any appropriate plastic materials having sufficient strength.

It should be understood that although the hand drill powered pump is shown in FIG. 6 as having two draw tube segments coupled together, the hand drill powered pump may also operate using a single draw tube segment which may simplify the design of the system.

Figure 16:
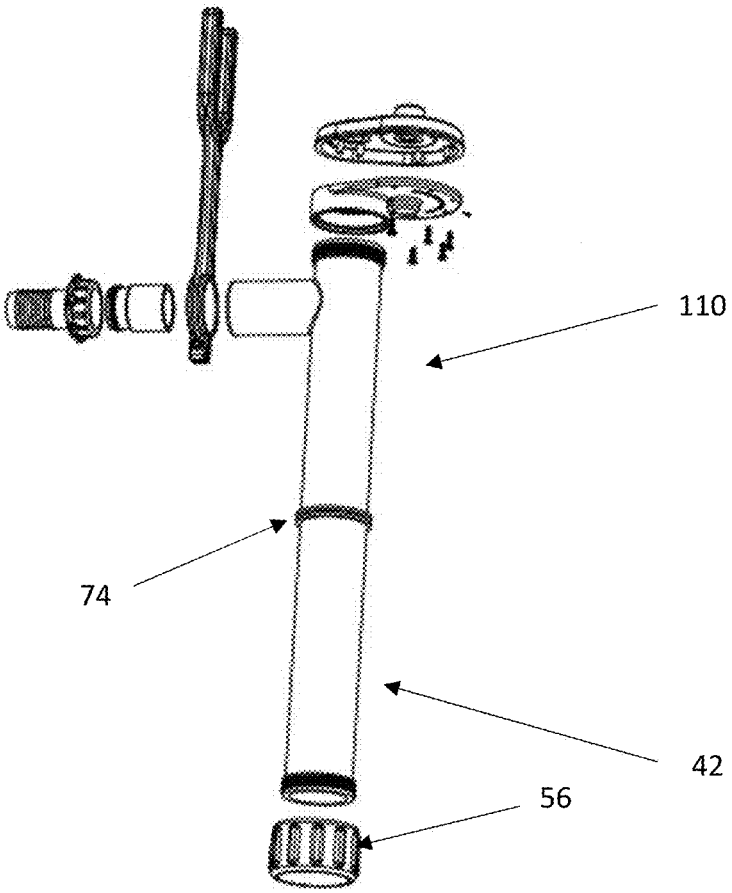
FIG. 16 is a perspective view of a second embodiment of the invention that only has a single draw tube segment instead of two of the first embodiment.

In a second embodiment of the invention shown in FIG. 16, there is only a single draw tube segment instead of the two shown in the first embodiment. Thus, the hand drill powered pump 110 includes the draw tube 42 and an end ring 56, while all other components internally are the same except there is no flow device 66. Thus, the hand drill powered pump 110 has a fluid flow rate of at least 10 gallons per minute (GPM), said pump comprised of a draw tube 42 having a top end and a suction end, a gear assembly disposed on the top end of the draw tube and having a plurality of gears disposed therein, wherein the gear assembly includes an input gear having an attachment for a hand drill, and a driveshaft gear. A fluid outlet is disposed below and adjacent to the gear assembly, wherein the fluid outlet is disposed perpendicular to the draw tube at the top end. A bottom support ring is disposed at the suction end of the draw tube. A bottom-flow device is disposed directly adjacent and above the bottom support ring. A bottom suction impeller is disposed directly adjacent to and above the bottom-flow device. A driveshaft is disposed inside a center of the draw tube along a length thereof, wherein the driveshaft is coupled at a top end to the driveshaft gear and passes through the bottom suction impeller, the bottom-flow device and ends at the bottom support ring. A removable filtering screen is disposed over the suction end of the draw tube.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A hand drill powered pump having a fluid flow rate of at least 10 gallons per minute (GPM), said pump comprised of:

a rigid draw tube having a top end and a suction end;

a gear assembly disposed on the top end of the draw tube and having a plurality of gears disposed therein, wherein the gear assembly includes an input gear having an attachment for a hand drill, and a driveshaft gear;

a fluid outlet disposed below and adjacent to the gear assembly, wherein the fluid outlet is disposed perpendicular to the draw tube at the top end;

a bottom support ring disposed at the suction end of the draw tube;

a bottom-flow device disposed directly adjacent and above the bottom support ring;

a bottom suction impeller disposed directly adjacent to and above the bottom-flow device;

a rigid and segmented driveshaft disposed inside a center of the draw tube along a length thereof, wherein the driveshaft is coupled at a top end to the driveshaft gear and passes through the bottom suction impeller, the bottom-flow device and ends at the bottom support ring, and wherein the driveshaft segments may be added or subtracted to thereby increase or decrease a total length of the driveshaft;

a removable filtering screen disposed over the suction end of the draw tube; and a hand drill mounting fork disposed at the top end of the draw tube.

2. The hand drill powered pump as defined in claim 1 wherein the rigid and segmented driveshaft is further comprised of:

a plurality of solid driveshaft segments, wherein the solid driveshaft segments are disposed along the driveshaft at locations where the driveshaft is supported by the rigid draw tube; and a plurality of hollow driveshaft segments, wherein the hollow driveshaft segments are disposed along the driveshaft at locations where the driveshaft is not supported by the rigid draw tube.

3. The hand drill powered pump as defined in claim 2 wherein the plurality of solid driveshaft segments and the plurality of hollow driveshaft segments are coupled to each other using a threaded engagement.

4. The hand drill powered pump as defined in claim 3 wherein the threaded engagement is locked using an adhesive or a thread retaining compound.

5. The hand drill powered pump as defined in claim 4 wherein the locations where the rigid driveshaft is supported by the rigid draw tube are locations where bearings and bushings support the driveshaft against an interior of the rigid draw tube.

6. A method of pumping a fluid using a hand drill powered pump having a fluid flow rate of at least 10 gallons per minute (GPM), said method comprising:

providing a rigid draw tube having a top end and a suction end, a gear assembly disposed on the top end of the draw tube and having a plurality of gears disposed therein, wherein the gear assembly includes an input gear having an attachment for a hand drill, and a driveshaft gear, a fluid outlet disposed below and adjacent to the gear assembly, wherein the fluid outlet is disposed perpendicular to the draw tube at the top end, a bottom support ring disposed at the suction end of the draw tube, a bottom-flow device disposed directly adjacent and above the bottom support ring, a bottom suction impeller disposed directly adjacent to and above the bottom-flow device, a rigid and segmented driveshaft disposed inside a center of the draw tube along a length thereof, wherein the rigid and segmented driveshaft is coupled at a top end to the driveshaft gear and passes through the bottom suction impeller, the bottom-flow device and ends at the bottom support ring, and a removable filtering screen disposed over the suction end of the draw tube, and a hand drill mounting fork disposed at the top end of the draw tube;

adding or subtracting driveshaft segments to thereby increase or decrease a total length of the driveshaft;

attaching a hand drill to the gear assembly such that a grip of the hand drill is disposed in the hand drill mounting to prevent hand drill rotation;

attaching the hand drill to the input gear;

directing the suction end of the draw tube to a fluid to be pumped; and pumping the fluid from the suction end to the fluid outlet by activating the hand drill.

7. The method of pumping a fluid using a hand drill powered pump as defined in claim 6 wherein the method further comprises reducing vibration of the driveshaft and thereby increasing a speed of the hand drill by forming the driveshaft from a plurality of solid driveshaft segments and hollow driveshaft segments.

8. The method of pumping a fluid using a hand drill powered pump as defined in claim 7 wherein forming the driveshaft from a plurality of solid driveshaft segments and hollow driveshaft segments to reduce vibration of the driveshaft further comprises:

disposing the solid driveshaft segments along the driveshaft at locations where the driveshaft is supported by the rigid draw tube; and disposing the hollow driveshaft segments along the driveshaft at locations where the driveshaft is not supported by the rigid draw tube.

9. The method of pumping a fluid using a hand drill powered pump as defined in claim 8 wherein the method further comprises rotating the driveshaft at RPMs between 1500 and 20,000 without vibration by using the plurality of driveshaft segments.

10. The method of pumping a fluid using a hand drill powered pump as defined in claim 9 wherein the method further comprises creating the driveshaft from the plurality of driveshaft segments by coupling the plurality of solid driveshaft segments to the plurality of hollow driveshaft segments using a threaded engagement.

11. The method of pumping a fluid using a hand drill powered pump as defined in claim 10 wherein the method further comprises locking the threaded segments of the driveshaft to each using an adhesive or a thread retaining compound.

12. The method of pumping a fluid using a hand drill powered pump as defined in claim 11 wherein the method further comprises supporting the driveshaft within the rigid draw tube by disposing the plurality of solid driveshaft segments at locations where bearings and bushings support the driveshaft against an interior of the rigid draw tube.

* * * * *